US007610940B2

(12) United States Patent
Tasca

(10) Patent No.: US 7,610,940 B2
(45) Date of Patent: Nov. 3, 2009

(54) CROSSBAR FOR HEALD-CARRYING FRAMES OF WEAVING LOOMS WITH IMPROVED ATTACHMENT OF THE HEALD-CARRYING PLATE

(75) Inventor: Egidio Tasca, Stezzano (IT)

(73) Assignee: Promatech S.p.A., Colzate (Bergamo) (IT)

( * ) Notice: Subject to any disclaimer, the term of this patent is extended or adjusted under 35 U.S.C. 154(b) by 0 days.

(21) Appl. No.: 11/583,737

(22) Filed: Oct. 20, 2006

(65) Prior Publication Data

US 2007/0113913 A1 May 24, 2007

(30) Foreign Application Priority Data

Nov. 23, 2005 (EP) ..... 05425829

(51) Int. Cl.
*D03C 9/06* (2006.01)
*D03C 9/00* (2006.01)
*D03C 13/00* (2006.01)

(52) U.S. Cl. ..... 139/91; 139/92

(58) Field of Classification Search ..... 139/91, 139/92

See application file for complete search history.

(56) References Cited

U.S. PATENT DOCUMENTS 3,754,577 A * 8/1973 Heller ..... 139/92
3,901,282 A * 8/1975 Kramer et al. ..... 139/92
4,106,529 A * 8/1978 Kaufmann ..... 139/92
4,633,916 A * 1/1987 Rast ..... 139/92
4,913,193 A * 4/1990 Faasse ..... 139/91
4,913,194 A 4/1990 Kramer et al.
5,178,192 A * 1/1993 Koch ..... 139/91
5,230,370 A * 7/1993 Gysin ..... 139/92
5,280,810 A * 1/1994 Shimizu ..... 139/91
5,345,974 A * 9/1994 Bernardi et al. ..... 139/91
6,446,676 B1 * 9/2002 Magri et al. ..... 139/92
6,926,042 B2 * 8/2005 Scheiwe ..... 139/91
7,147,010 B2 * 12/2006 Froment et al. ..... 139/91
7,231,942 B2 * 6/2007 Gesing ..... 139/91
2005/0109417 A1 * 5/2005 Gesing ..... 139/55.1
2007/0113913 A1 * 5/2007 Tasca ..... 139/55.1

FOREIGN PATENT DOCUMENTS

EP 1170409 1/2002
EP 1624097 2/2006
FR 2857674 1/2005

* cited by examiner

*Primary Examiner*—Bobby H Muromoto, Jr.
(74) *Attorney, Agent, or Firm*—Young & Thompson

(57) ABSTRACT

Crossbar for heald-carrying frames of weaving looms comprising a main element of the crossbar made, at least in part, of a light metallic material, such as aluminium, magnesium or alloys thereof; and a heald-carrying element made of a high-resistance material, such as steel. The heald-carrying element is steadily fastened to the main element of the crossbar by means of a lock joint, through plastic strain between a longitudinal rib projecting from the main element of the crossbar and a corresponding groove formed in the heald-carrying element.

10 Claims, 3 Drawing Sheets

CROSSBAR FOR HEALD-CARRYING FRAMES OF WEAVING LOOMS WITH IMPROVED ATTACHMENT OF THE HEALD-CARRYING PLATE

BACKGROUND OF THE INVENTION

1. Field of the Invention

The present invention refers to a crossbar for heald-carrying frames comprising an improved attachment of the heald-carrying plate to said crossbar.

2. Description of the Related Art

As is well known to skilled people in the field, the heald-carrying frame is a device used in weaving looms to achieve the shifting of groups of warp yarns, thanks to the alternate movement thereof in a vertical plane perpendicular to the weaving plane. In the weaving loom a certain number of heald-carrying frames is arranged, the greater the degree of complexity of the pattern to be woven on the fabric, the higher the number of such frames, and the individual frames are controlled by a weaving machine in order to achieve a preset pattern on the fabric.

Each heald-carrying frame comprises a rectangular rim consisting of two side elements making up the guides for the alternate sliding of the frame, and of two horizontal elements, called crossbars, on whose opposite inner sides a plurality of thin steel rods is fastened, provided with an intermediate eye for one or more warp yarns to pass through. Such rods are called indeed healds.

The two side elements and the two crossbars must further be mutually fastened at a right angle, in the angular positions of the frame, so as to provide a rigid and stable structure, capable of withstanding the high stress levels which the frame undergoes during its rapid, and sometimes very rapid, alternate movement within the loom.

Over the last few years continuous efforts have been made to improve the performance of the above-said devices, in particular towards reducing the mass and increasing the useful life thereof. Such objects are of course in conflict, since a lighter structure is more prone to fatigue breaking, which typically represent the most frequent cause of breaking of the devices undergoing continuous and rapid inversions of inner stresses, as indeed in the case of heald-carrying frames. In order to reduce the incidence of this problem, a number of attempts have been made to form the crossbars using, instead of the conventional aluminium-based light alloy metal sheets or light alloy metal sheets made of other low specific-weight metals, composite materials made of different types of fibres, synthetic resins and foam materials, all materials which are less affected by the problem of fatigue breaking over metallic materials. However, the much higher costs of this type of heald-carrying frames has not allowed a sufficiently wide diffusion thereof yet and the frames in metallic materials consequently still represent a considerable portion of the market.

Such frames, however, have—as shown—an excessively short useful life, especially in connection with the inherent fragility induced in a heald-carrying frame by the system fastening the heald-carrying plates to their respective crossbars. As a matter of fact, the majority of the frames on the market currently provides a mutual fastening by means of rivets of the above-said components. This system—which is certainly very inexpensive, safe and allows quick assembly, and which is consequently currently preferred—however, has remarkable and noticeable disadvantages, particularly in terms of its dramatic reduction of the fatigue-withstanding properties of the crossbars.

As a matter of fact, as is known, the operations of crossbar drilling, and of the subsequent upsetting of the rivet on the respective holes for the fastening of the heald-carrying plate, induce very strong localised stresses in the metallic profile making up the crossbar. These, understandably, drastically reduce the fatigue breaking limit of the crossbar, and as a result cause a very short useful life of the heald-carrying frames.

This problem then becomes the more serious the faster the looms whereon the heald-carrying frames are mounted; as a matter of fact, the higher speed implies greater dynamic stresses and a higher number of cycles of alternate stresses per time unit, both conditions reducing the fatigue limit. In the more recent air-jet looms, wherein weaving speeds are extremely high, the problem of breaking frequency or of scheduled replacement of the heald-carrying frames has hence become such as to negatively affect the entire weaving operation.

BRIEF SUMMARY OF THE INVENTION

It is hence the object of the present invention to provide a crossbar for heald-carrying frames overcoming the drawbacks highlighted above and hence having—still keeping the market-demanded crossbar structure made of light metallic materials—a much longer useful life than that of the crossbars currently on the market.

According to the invention, such object is achieved by means of a crossbar with an improved fastening of the heald-carrying plates having the features reported in the accompanying main claim. Further features of the crossbar of the invention are reported in the dependent claims.

BRIEF DESCRIPTION OF THE DRAWING FIGURES

The invention will now be described in greater detail, with reference to an embodiment of the same, among the many ones possible, shown in a diagrammatic way in the accompanying drawings, wherein.

Figure 2:
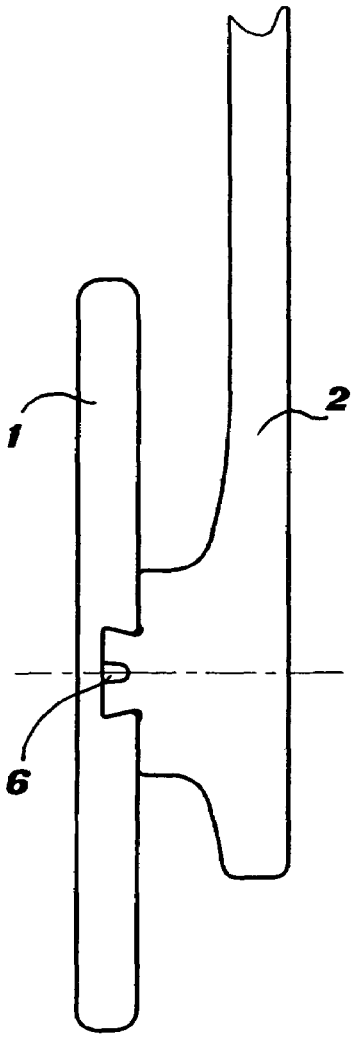
FIG. 2 is a similar view to FIG. 1, wherein the two parts are mutually assembled and make up the end extension of a crossbar ready for use.
Figure 1:
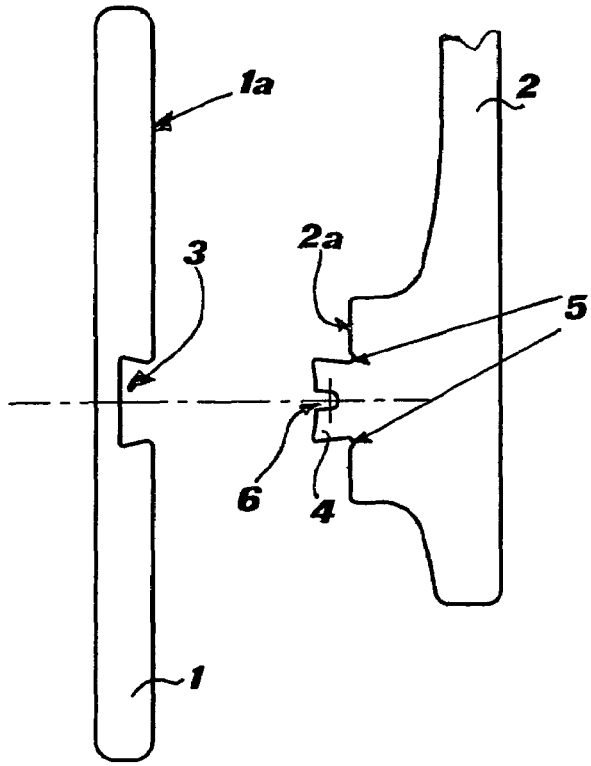
FIG. 1 is an elevation side exploded view with parts separated of the end extension of a crossbar for heald-carrying frames and of a heald-carrying plate according to a first embodiment of the invention.
Figure 4:
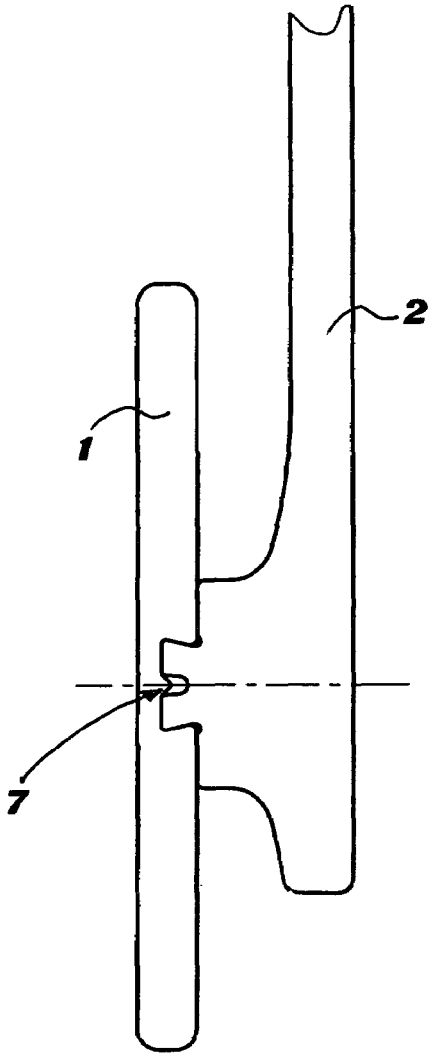
Figure 3:
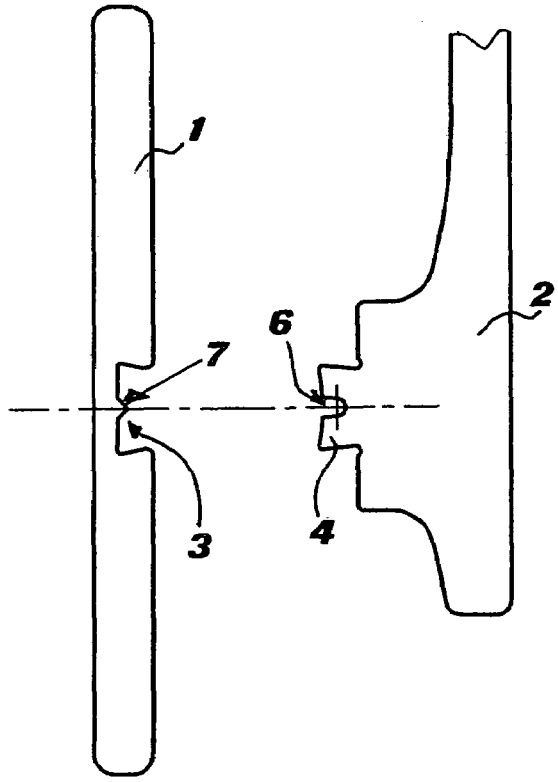
Figure 6:
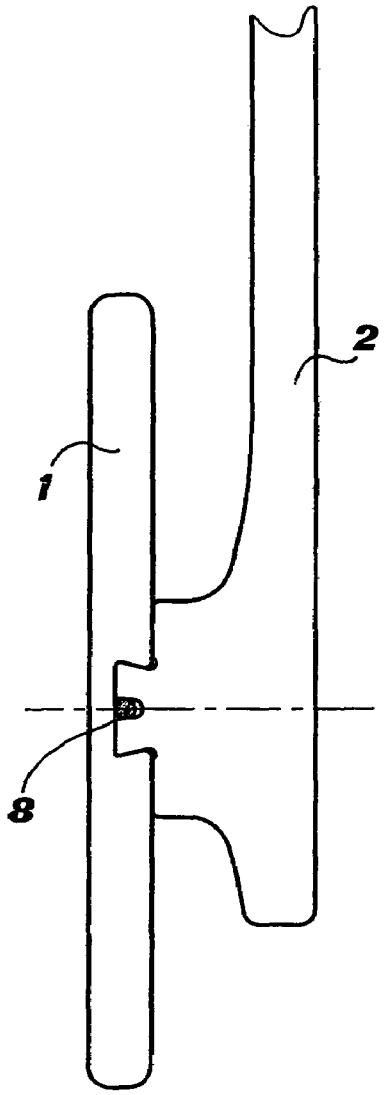
Figure 5:
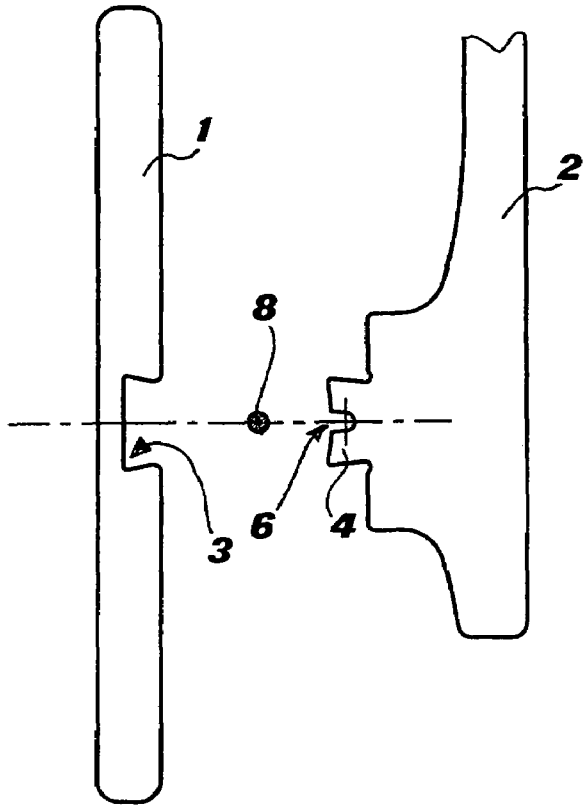

FIGS. 3 and 4 are similar views to FIGS. 1 and 2 which show a second embodiment of the invention; and FIGS. 5 and 6 are similar views to FIGS. 1 and 2 which show a third embodiment of the invention.

DETAILED DESCRIPTION OF THE PREFERRED EMBODIMENTS

FIGS. 1 and 2 show a heald-carrying plate 1 and an end extension 2 of a crossbar for heald-carrying frames intended for the formation of a heald-carrying frame. As a matter of fact, as is well-known to skilled people in the field, a crossbar for heald-carrying frames comprises a box-like portion—intended to impart structural rigidity to the crossbar and arranged on the external part of the frame—and an extension projecting therefrom, towards the inside of the frame, whereto the heald-carrying plate is fastened. Such extension is precisely the one shown in the drawings and which, for greater clarity, will be simply called "crossbar" in the following.

Plate 1 consists of a rectangular-section bar having rounded-off edges, of a material having high mechanical and wear-withstanding properties, such as for example a steel alloy or other metallic alloys, so as to be able to directly withstand the repeated forces and impacts discharged thereon by the healds. Plate 1 is shaped so as to have, on the side facing crossbar 2, a longitudinal groove 3 whose side walls have a certain degree of undercut, for example a dove-tail-section groove of the type shown in the drawings.

Crossbar 2 supports said plate 1 and consists, as seen above, of a solid profile of light metallic material, in particular aluminium or magnesium or some sort of special alloy made of these or other metals having a low specific weight. In correspondence of the area of engagement with plate 1, crossbar 2 comprises a longitudinal rib 4 apt to tightly fit groove 3 of plate 1.

At the bottom of rib 4, crossbar 2 has suitable flutes 5, apt to allow a perfect abutment between the inner face 1*a* of plate 1 and the corresponding resting surface 2*a* of crossbar 2, when these two elements are brought into contact by introducing rib 4 in groove 3.

At the top of rib 4 a recess 6 is instead provided, apt to ease the plastic strain of rib 4 during the operations of introduction and upsetting of said rib into groove 3.

In order to accomplish the coupling between plate 1 and crossbar 2, said elements are firstly joined introducing rib 4 into groove 3 and they are then exposed to pressure in a mounting press. During this operation rib 4, which for this purpose has a height slightly greater than the depth of groove 3, undergoes a plastic strain which allows it to adapt perfectly to the inner form of groove 3, hence remaining tightly and steadily anchored to the same due to the undercut with which such groove is shaped.

The crossbar obtained by the above-described fastening, in addition to allowing a perfectly stable and slack-free coupling over time between crossbar 2 and plate 1, has the remarkable advantage of requiring no prior drilling operation of the crossbar 2 made of light metallic material which is hence not weakened in any way. Moreover, the coupling is accomplished along the entire crossbar, in a continuous and simultaneous manner; localised deformations and the consequent concentrated stresses, typical of known-type crossbars wherein the plate/crossbar coupling was accomplished by using rivets, are hence fully removed. Finally, the above-described plate/crossbar coupling can be mounted extremely quickly, thereby contributing to a reduction of the manufacturing costs of the heald-carrying frame.

In order to facilitate the plastic deformation of rib 4, it is possible to provide, within groove 3, longitudinal elements of a suitable shape and arrangement which are sufficiently rigid to be non-deformable with respect to the light alloy material making up the crossbar, said elements being apt to cooperate with recess 6 during the step of mounting plate 1 and crossbar 2 on the press.

In a second embodiment of the invention, shown in FIGS. 3 and 4, such longitudinal element consists of a bead 7 formed in an axial position within groove 3. During mounting, bead 7 wedges itself into recess 6, easing the bilateral plastic strain of rib 4 and partially occupying, once mounted, the clearance of recess 6.

In a third embodiment of the invention, shown in FIGS. 5 and 6, such longitudinal element consists instead of a steel wire 8 which is laid upon and provisionally fastened, for example by gluing, along the entire mouth of recess 6, the diameter of wire 8 being greater than the opening of said mouth. During mounting, following the introduction of rib 4 into groove 3, wire 8 rests against the bottom of the groove itself and hence facilitates, in a fully similar way to what has already been said for bead 7, the bilateral plastic strain of rib 4. At the end of the assembly operation, rib 4 has undergone the desired, permanent plastic strain occupying the undercut area of groove 3, whereas thread 8 has occupied almost entirely the clearance of recess 6.

From what has been set forth above it is clear how the crossbar of the present invention has fully achieved the desired object, considering that the useful life of the crossbar has noticeably increased, on the one hand because any form of localised structural weakening of the crossbar—due to drilling of the same and subsequent upsetting on the holes of the rivets used for connecting the heald-carrying plate—is avoided and, on the other hand, because a plate/crossbar coupling with a continuous fastening is accomplished, thereby achieving perfect distribution on the crossbar of the stresses induced on the plate by the action of the healds.

The above-reported description has been given with specific reference to the embodiments shown in the drawings and must hence be considered only as illustrative of the invention. A number of other embodiments of the particular plate/cross-member attachment characterising the invention are possible, in particular changing the shape and arrangement of groove 3 and correspondingly of rib 4, by means of devices within easy reach of a person skilled in the field, which must consequently all be considered comprised in the scope of protection of the invention, as defined in the accompanying claims.

The invention claimed is:

1. A crossbar for heald-carrying frames of weaving looms, comprising:

a main element of the crossbar comprising a light metallic material; and a heald-carrying element comprising a high-resistance material and steadily fastened to said main element of the crossbar, wherein the fastening between said elements comprises a lock joint between a longitudinal rib protruding from said main element of the crossbar and a corresponding groove formed in said heald-carrying element of the crossbar, said groove comprises at least an undercut portion, said longitudinal rib has a height slightly greater than a depth of the corresponding groove, and wherein said lock joint implies a permanent plastic strain of said rib.

2. The crossbar for heald-carrying frames as claimed in claim 1, wherein said groove has a dove-tail section.

3. The crossbar for heald carrying frames as claimed in claim 1, wherein said rib and groove extend along the entire crossbar length.

4. The crossbar for heald-carrying frames as claimed in claim 1, wherein said rib is integrally formed with said main element of the crossbar.

5. The crossbar for heald-carrying frames as claimed in claim 1, wherein said light metallic material is aluminum, magnesium or an alloy thereof.

6. The crossbar for heald-carrying frames as claimed in claim 1, wherein said high-resistance material is steel.

7. The crossbar for heald-carrying frames as claimed in claim 1, wherein said rib has a longitudinal recess in an axial position on a side facing said groove.

8. The crossbar for heald-carrying frames as claimed in claim 1, further comprising a longitudinal profile apt to wedge into a recess to ease, during the pressure coupling between the main element of the crossbar and the heald-carrying element, a bilateral plastic strain of the rib of the former within the groove of the latter.

9. The crossbar for heald carrying frames as claimed in claim 8, wherein said profile comprises a bead integrally formed in said heald-carrying element in an axial position on a bottom of the groove of the same.

10. The crossbar for heald carrying frames as claimed in claim 8, wherein said profile comprises a steel wire having a slightly larger diameter than a mouth of the recess formed on the rib of the main element of the crossbar and provisionally fastened on the same before pressure coupling between said main element and the heald-carrying element.

* * * * *